US012649988B1

(12) United States Patent
Wright, Sr.

(10) Patent No.: US 12,649,988 B1
(45) Date of Patent: Jun. 9, 2026

(54) SOCK PAIR HOLDER AND ASSOCIATED METHOD(S)

(71) Applicant: Fernando P. Wright, Sr., Louisville, KY (US)

(72) Inventor: Fernando P. Wright, Sr., Louisville, KY (US)

( * ) Notice: Subject to any disclaimer, the term of this patent is extended or adjusted under 35 U.S.C. 154(b) by 57 days.

(21) Appl. No.: 18/583,524

(22) Filed: Feb. 21, 2024

Related U.S. Application Data

(60) Provisional application No. 63/486,076, filed on Feb. 21, 2023.

(51) Int. Cl.
*D06F 95/00* (2006.01)

(52) U.S. Cl.
CPC ..... *D06F 95/008* (2013.01)

(58) Field of Classification Search
CPC ..... D06F 95/008; A41B 11/002; A44B 99/00; Y10T 24/44752; Y10T 24/44274; Y10T 24/44376; Y10T 24/4453; Y10T 24/44564; Y10T 24/44538; Y10T 24/44906; Y10T 24/44915; Y10T 24/44923; Y10T 24/44932; Y10T 24/44291; Y10T 24/44641; Y10T 24/44744; F16B 2/02; F16B 2/10; F16B 2/06

See application file for complete search history.

(56) References Cited

U.S. PATENT DOCUMENTS

| | | | | |
|---|---|---|---|---|
| 3,369,279 | A * | 2/1968 | Erteszek | A41F 11/08 24/487 |
| 3,699,617 | A * | 10/1972 | Hofmeister | A44B 99/00 24/578.13 |
| 5,671,876 | A * | 9/1997 | Gardner | D06F 95/008 24/336 |
| 10,722,062 | B1 * | 7/2020 | Clarke | A47H 5/02 |
| 10,920,366 | B1 * | 2/2021 | Mulholland | D06F 95/008 |
| 2002/0073519 | A1 * | 6/2002 | Simon | D06F 95/008 24/545 |
| 2006/0101627 | A1 * | 5/2006 | Ida | A44B 11/26 24/517 |
| 2007/0256280 | A1 * | 11/2007 | Azan | D06F 95/008 24/90.1 |
| 2025/0051999 | A1 * | 2/2025 | Opher | D06F 95/008 |

* cited by examiner

*Primary Examiner* — Jason W San
*Assistant Examiner* — Louis A Mercado
(74) *Attorney, Agent, or Firm* — Ashkan Najafi

(57) ABSTRACT

A sock pair accessory includes a single, unitary, and resiliently foldable layer having a central longitudinal axis and including a central section; a proximal section and a distal section each being flexibly and monolithically connected to opposed edges of the central section, respectively, and a plurality of fasteners attached to the proximal section. The fasteners are configured to selectively engage and disengage the distal section and when the proximal section and the distal section are selectively articulated towards and away from each other, respectively, between attached and detached positions, respectively. The single, unitary, and resiliently foldable layer has a planar and rectilinear configuration when disposed at the detached position.

16 Claims, 4 Drawing Sheets

SOCK PAIR HOLDER AND ASSOCIATED METHOD(S)

CROSS REFERENCE TO RELATED APPLICATIONS

This is a non-provisional patent application that claims priority to and benefit of U.S. provisional patent application No. 63/486,076 filed Feb. 21, 2023, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to clothing accessories and, more particularly, to a specially configured sock pair accessory including a foldable implement (single, unitary, and resiliently foldable layer) that is selectively opened/closed for releasing/maintaining a sock pair together during washing and drying procedures.

Prior Art

The task of laundering socks or similar pairs of socks presents difficulties because of the similarities of hue and texture of socks whether there be only one member in the family wearing such sock or a number of family members. Much of the modern day home laundering involves drying in automatic tumble driers. Where socks are made of synthetic fibers, the handling and sorting of sock is further complicated by the static electrical charges which tend to hold mismatched sock together. Even when the socks are not dried in this manner there is the problem of sorting and matching them after they have been laundered in a washing machine. Some of the drudgery of household laundering could be eliminated by reducing the work required for sorting and matching of socks or similar socks as part of the task of laundering household clothing.

The sorting of socks into their proper pairs after laundering is both time consuming and tedious for the housewife. This is especially true today since socks come in a variety of colors and fabrics, many of which differ from each other by only a slight degree and only can be matched properly in natural light or high illumination artificial light.

Existing connectors that have been used for this purpose are all detachable and are removed from the socks when the socks are being worn. This necessitates maintaining a supply of connectors at various locations in the house where the members of a family remove their socks in order that the socks are immediately joined together before placing them in a laundry box or the like. Likewise, since the existing connectors are detachable from the socks, they are subject to loss and misplacement.

Accordingly, a need remains for a specially configured sock pair accessory to overcome at least one of the above-noted shortcomings. The exemplary embodiment(s) satisfy such a need by a foldable implement (single, unitary, and resiliently foldable layer) that is convenient and easy to use, lightweight yet durable in design, versatile in its applications, and configured to be selectively opened/closed for releasing/maintaining a sock pair together during washing and drying procedures.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured sock pair accessory including a foldable implement (single, unitary, and resiliently foldable layer) that is selectively opened/closed for releasing/maintaining a sock pair together during washing and drying procedures. These and other objects, features, and advantages of the non-limiting exemplary embodiment(s) are provided by a sock pair accessory for maintaining a sock pair together during washing and drying procedures is disclosed. The sock pair accessory includes a single, unitary, and resiliently foldable layer having a central longitudinal axis and including a central section, a proximal section and a distal section each being flexibly and monolithically connected to opposed edges of the central section, respectively, and a plurality of fasteners attached to the proximal section. Advantageously, the fasteners are configured to selectively engage and disengage the distal section and when the proximal section and the distal section are selectively articulated towards and away from each other, respectively, between attached and detached positions, respectively. Advantageously, the single, unitary, and resiliently foldable layer has a planar and rectilinear configuration when disposed at equilibrium at the detached (open) position 61. The open position 61 is at equilibrium and the closed position 60 is tensioned. Advantageously, the central section is integral with the proximal section and the distal section.

In a non-limiting exemplary embodiment, each of the fasteners is attached to an opposed longitudinal edge of the proximal section and is oriented perpendicular thereto, respectively. Advantageously, each of the fasteners has a plurality of teeth protruding inwardly towards the central longitudinal axis.

In a non-limiting exemplary embodiment, the layer further has a plurality of first friction inducing members statically attached to the proximal section, and a plurality of second friction inducing members statically attached to the distal section and offset from the plurality of first friction inducing members. Advantageously, each of the plurality of first friction inducing members and the plurality of second friction inducing members remain spaced apart when the proximal section is attached to the distal section.

In a non-limiting exemplary embodiment, the central section has a cross-sectional thickness less than associated cross-sectional thicknesses of the proximal section and the distal section, respectively. Advantageously, the central section has a central latitudinal axis registered orthogonal to the central longitudinal axis. Advantageously, the central latitudinal axis is medially disposed between the proximal section and the distal section.

In a non-limiting exemplary embodiment, the layer further includes a first shoulder located at a first junction between the central section and the proximal section, and a second shoulder located at a second junction between the central section and the distal section. Advantageously, the first shoulder remains spaced apart from the second shoulder when the fasteners are engaged with the distal section.

In a non-limiting exemplary embodiment, each of the proximal section and the distal section has a plurality of apertures equidistantly offset from the central latitudinal axis.

In a non-limiting exemplary embodiment, the central section is configured to be a living hinge.

In a non-limiting exemplary embodiment, each of the plurality of first friction inducing members and the second plurality of friction inducing members has a cone shape.

In a non-limiting exemplary embodiment, the proximal section has a shape that is symmetric to a shape of the distal section.

In a non-limiting exemplary embodiment, the fasteners are statically affixed to the proximal section and disposed adjacent to the first shoulder.

There has thus been outlined, rather broadly, the more important features of non-limiting exemplary embodiment (s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figures 1, 2, 3:
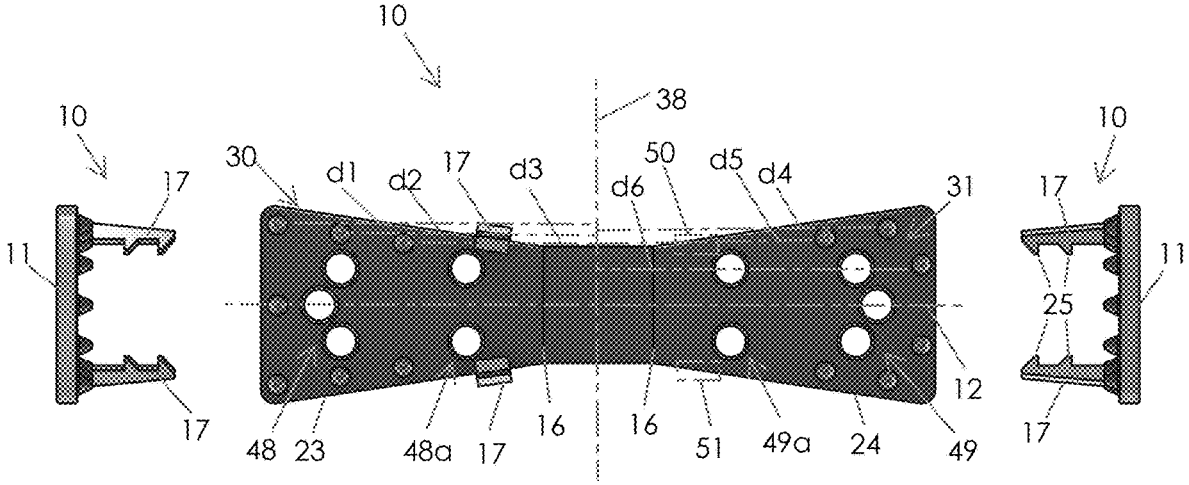
FIG. 1 is a top plan view of the sock pair holder at an open position, in accordance with a non-limiting exemplary embodiment of the present disclosure.
FIG. 2 is a front elevational view of the sock pair holder shown in FIG. 1.
FIG. 3 is a rear elevational view of the sock pair holder shown in FIG. 1.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational and are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment (s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means ±15% of the numerical.

If used herein, "substantially" means largely if not wholly that which is specified but so close that the difference is insignificant.

Figure 4:
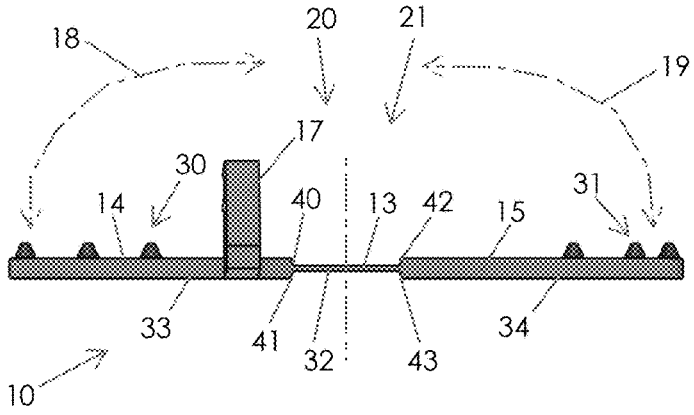
FIG. 4 is a side elevational view of the sock pair holder shown in FIG. 1.
Figure 5:
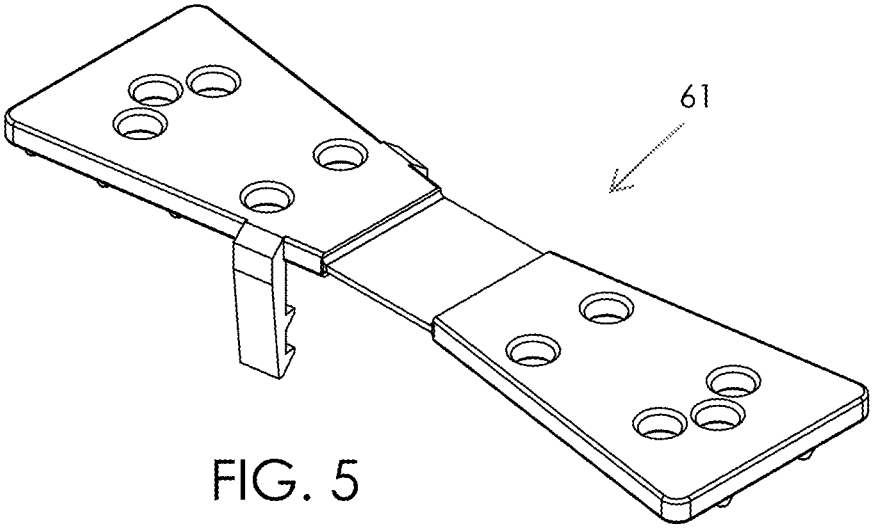
FIG. 5 is a perspective view of the sock pair holder shown in FIG. 1.
Figure 6:
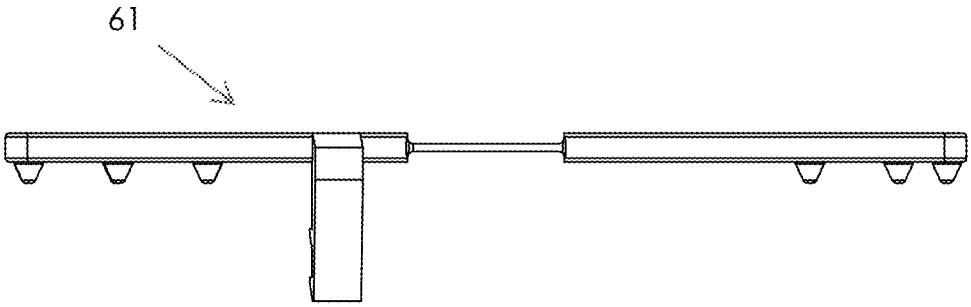
FIG. 6 is another side elevational view of the sock pair holder shown in FIG. 1.
Figure 7:
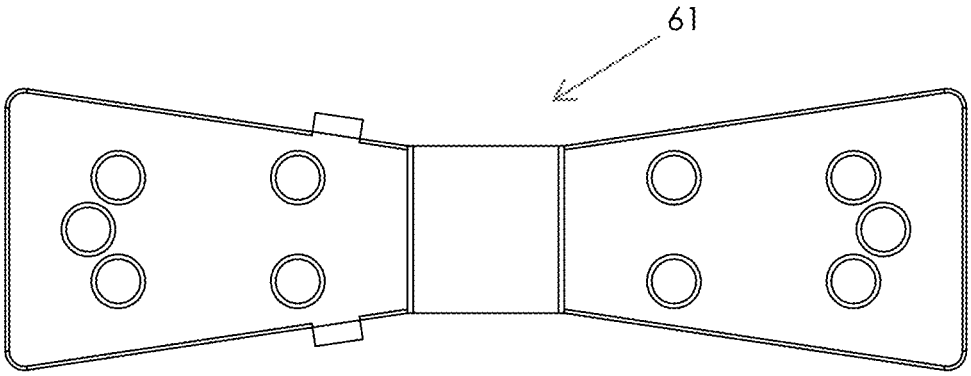
FIG. 7 is a top plan view of the sock pair holder shown in FIG. 1.
Figure 8:
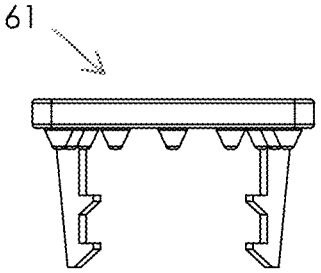
FIG. 8 is another front elevational view of the sock pair holder shown in FIG. 1.
Figure 9:
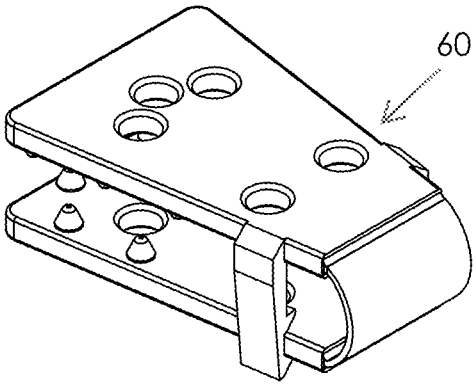
FIG. 9 is a perspective view of the sock pair holder at a folded (closed) position.
Figure 10:
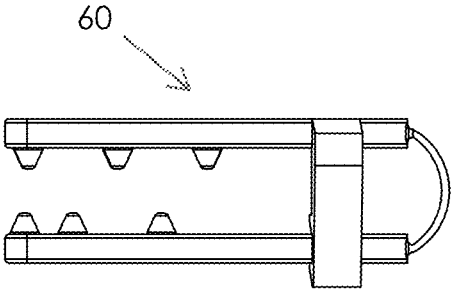
FIG. 10 is a side elevational view of the sock pair holder shown in FIG. 9.
Figure 11:
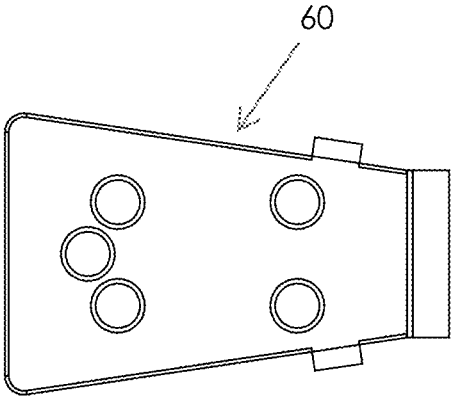
FIG. 11 is a top plan view of the sock pair holder shown in FIG. 9.
Figure 12:
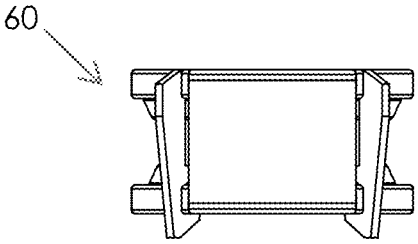
FIG. 12 is a rear elevational view of the sock pair holder shown in FIG. 9.
Figure 13:
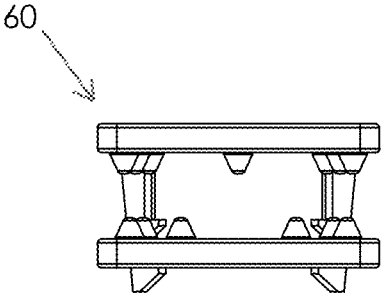
FIG. 13 is a front elevational view of the sock pair holder shown in FIG. 9.
Figure 14:
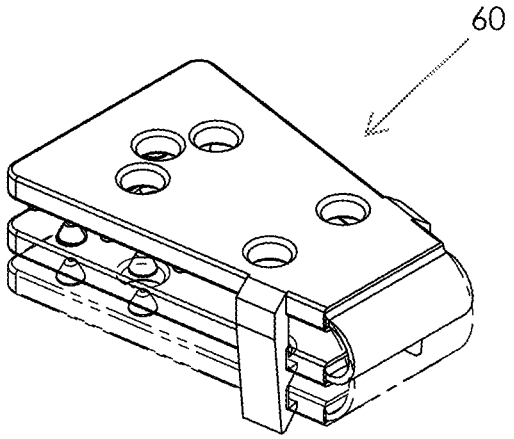
FIG. 14 is a perspective view showing folding (closing) movement of the sock pair holder shown in FIG. 9.
Figure 15:
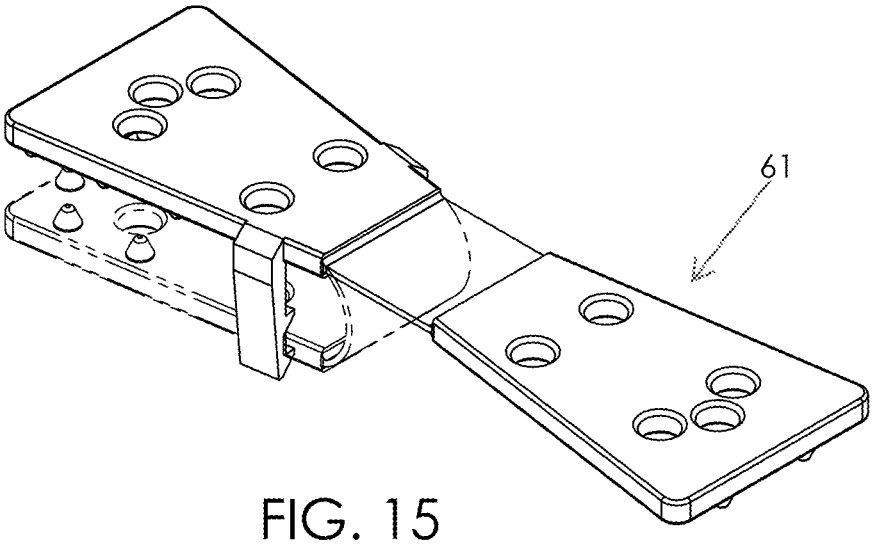
FIG. 15 is another perspective view showing folding (closing) and unfolding (opening) movements of the sock pair holder shown in FIG. 9.

The non-limiting exemplary embodiment(s) is/are referred to generally in FIGS. 1-15 and is/are intended to provide a specially configured sock pair accessory 10 including a foldable implement (single, unitary, and resiliently foldable layer 11) that is selectively opened/closed for releasing/maintaining a sock pair together during washing and drying procedures. It should be understood that the exemplary embodiment(s) may be used to secure a variety of socks and should not be limited to any particular sock described herein.

Referring to FIGS. 1-15 in general, in a non-limiting exemplary embodiment(s), a sock pair accessory 10 for maintaining a sock pair together during washing and drying procedures is disclosed. The sock pair accessory 10 includes a single, unitary, and resiliently foldable layer 11 having a central longitudinal axis 12 and including a central section 13, a proximal section 14 and a distal section 15 each being flexibly and monolithically connected to opposed edges 16 of the central section 13, respectively, and a plurality of fasteners 17 attached to the proximal section 14. Advantageously, the fasteners 17 are configured to selectively engage and disengage the distal section 15 and when the proximal section 14 and the distal section 15 are selectively articulated towards and away from each other (along arcuate paths 18, 19), respectively, between attached and detached positions, respectively. Advantageously, the single, unitary, and resiliently foldable layer 11 has a planar and rectilinear configuration 20 when disposed at equilibrium 21 at the detached (open) position. The open position 61 is at equilibrium 21 and the closed position 60 is at a tensioned position (when the proximal section 14 is engaged and locked to the distal section 15). Advantageously, the central section 13 is integral with the proximal section 14 and the distal section 15. Such a structural configuration yields the new, useful, and unpredicted result of gripping more of the sock surface while reducing manufacturing costs.

In a non-limiting exemplary embodiment, each of the fasteners 17 is attached to an opposed longitudinal edge 23, 24 of the proximal section 14 and is oriented perpendicular thereto, respectively. Advantageously, each of the fasteners 17 has a plurality of teeth 25 protruding inwardly towards the central longitudinal axis 12. Such a structural configuration yields the new, useful, and unpredicted result of gripping more of the sock surface while reducing manufacturing costs.

In a non-limiting exemplary embodiment, the layer 11 further has a plurality of first friction inducing members 30 statically attached to the proximal section 14, and a plurality of second friction inducing members 31 statically attached to the distal section 15 and offset from the plurality of first friction inducing members 30. Advantageously, each of the plurality of first friction inducing members 30 and the plurality of second friction inducing members 31 remain spaced apart when the proximal section 14 is attached to the distal section 15. Such a structural configuration yields the new, useful, and unpredicted result of gripping more of the sock surface while reducing manufacturing costs.

In a non-limiting exemplary embodiment, the central section 13 has a cross-sectional thickness 32 less than associated cross-sectional thicknesses 33, 34 of the proximal section 14 and the distal section 15, respectively. Advantageously, the central section 13 has a central latitudinal axis 38 registered orthogonal to the central longitudinal axis 12. Advantageously, the central latitudinal axis 38 is medially disposed between the proximal section 14 and the distal section 15. Such a structural configuration yields the new, useful, and unpredicted result of gripping more of the sock surface while reducing manufacturing costs.

In a non-limiting exemplary embodiment, the layer 11 further includes a first shoulder 40 located at a first junction 41 between the central section 13 and the proximal section 14, and a second shoulder 42 located at a second junction 43 between the central section 13 and the distal section 15. Advantageously, the first shoulder 40 remains spaced apart from the second shoulder 42 when the fasteners 17 are engaged with the distal section 15. Such a structural configuration yields the new, useful, and unpredicted result of gripping more of the sock surface while reducing manufacturing costs.

In a non-limiting exemplary embodiment, each of the proximal section 14 and the distal section 15 has a plurality of apertures 48, 48*a*, 49, 49*a* equidistantly offset from the central latitudinal axis 38. Such a structural configuration yields the new, useful, and unpredicted result of gripping more of the sock surface while reducing manufacturing costs.

In a non-limiting exemplary embodiment, the central section 13 is configured to be a living hinge 13*a*. Such a structural configuration yields the new, useful, and unpredicted result of gripping more of the sock surface while reducing manufacturing costs.

In a non-limiting exemplary embodiment, each of the plurality of first friction inducing members 30 and the plurality of second friction inducing members 31 has a cone shape. Each individual first friction inducing member 30 is located at a different linear distance d1, d2, d3 from the central latitudinal axis 38 compared to a different linear distance d4, d5, d6 of each second friction inducing member 31. Advantageously, such first and second friction inducing members 30, 31, respectively, are mutually exclusive and juxtaposed adjacent to each other when the accessory 10 is folded to the closed position 60. Such a structural configuration yields the new, useful, and unpredicted result of gripping more of the sock surface while reducing manufacturing costs.

In a non-limiting exemplary embodiment, the proximal section 14 has a shape that is symmetric to a shape of the distal section 15. Such a structural configuration yields the new, useful, and unpredicted result of gripping more of the sock surface while reducing manufacturing costs.

In a non-limiting exemplary embodiment, the fasteners 17 are statically affixed to the proximal section 14 and disposed adjacent to the first shoulder 40. Such a structural configuration yields the new, useful, and unpredicted result of gripping more of the sock surface while reducing manufacturing costs.

While various embodiments have been described, the description is intended to be exemplary, rather than limiting, and it is understood that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except considering the attached claims and their equivalents. Also, various modifications and changes may be made within the scope of the attached claims.

While the foregoing has described what are the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various examples for the purpose of streamlining the disclosure. This method of disclosure is not to be interpreted as reflecting an intention that the claims require more features than are expressly recited in each claim. Rather, as the following claims reflect, inventive subject matter lies in less than all features of a single disclosed example. Thus, the following claims are hereby incorporated into the Detailed Description, with each claim standing on its own as a separately claimed subject matter.

What is claimed as new and what is desired to secure by Letters Patent of the United States is:

1. A sock pair accessory for maintaining a sock pair together during washing and drying procedures, said sock pair accessory comprising: a single, unitary, and resiliently foldable layer having a central longitudinal axis and including a central section;

a proximal section and a distal section each being flexibly and monolithically connected to opposed edges of said central section, respectively; and a plurality of fasteners attached to said proximal section;

wherein said fasteners are configured to selectively engage and disengage said distal section and when said proximal section and said distal section are selectively articulated towards and away from each other, respectively, between attached and detached positions, respectively;

wherein said single, unitary, and resiliently foldable layer has a planar and rectilinear configuration when disposed at equilibrium at said detached position;

wherein each of said fasteners is attached to an opposed longitudinal rectilinear edge of said proximal section and is oriented perpendicular thereto, respectively; wherein each of said fasteners has a plurality of teeth protruding only inwardly towards said central longitudinal axis;

wherein said single, unitary, and resiliently foldable layer further has a plurality of first friction inducing members statically attached to said proximal section; and a plurality of second friction inducing members statically attached to said distal section and offset from said plurality of first friction inducing members;

wherein each of said plurality of first friction inducing members and said plurality of second friction inducing members remain spaced apart when said proximal section is attached to said distal section;

wherein said proximal section has a first planar top most surface and a first planar bottom most surface opposed therefrom;

wherein said distal section has a second planar top most surface and a second planar bottom most surface opposed therefrom;

wherein said proximal section has a first uniform cross-sectional thickness equal to a second uniform cross-sectional thickness of said distal section.

2. The sock pair accessory of claim 1, wherein said central section has a cross-sectional thickness less than said first uniform cross-sectional thickness of said proximal section and said second uniform cross-sectional thickness of said distal section, respectively;

wherein said central section has a central latitudinal axis registered orthogonal to said central longitudinal axis;

wherein said central latitudinal axis is medially disposed between said proximal section and said distal section.

3. The sock pair accessory of claim 2, wherein said layer further comprises:

a first shoulder located at a first junction between said central section and said proximal section; and a second shoulder located at a second junction between said central section and said distal section;

wherein said first shoulder remains spaced apart from said second shoulder when said fasteners are engaged with said distal section.

4. The sock pair accessory of claim 3, wherein each of said proximal section and said distal section has a plurality of apertures equidistantly offset from said central latitudinal axis.

5. The sock pair accessory of claim 4, wherein said central section is configured to be a living hinge.

6. The sock pair accessory of claim 5, wherein each of said plurality of first friction inducing members and said second plurality of friction inducing members has a cone shape.

7. The sock pair accessory of claim 6, wherein said proximal section has a shape that is symmetric to a shape of said distal section.

8. The sock pair accessory of claim 7, wherein said fasteners are statically affixed to said proximal section and disposed adjacent to said first shoulder.

9. A sock pair accessory for maintaining a sock pair together during washing and drying procedures, said sock pair accessory comprising: a single, unitary, and resiliently foldable layer having a central longitudinal axis and including a central section;

a proximal section and a distal section each being flexibly and monolithically connected to opposed edges of said central section, respectively; and a plurality of fasteners attached to said proximal section;

wherein said fasteners are configured to selectively engage and disengage said distal section and when said proximal section and said distal section are selectively articulated towards and away from each other, respectively, between attached and detached positions, respectively;

wherein said single, unitary, and resiliently foldable layer has a planar and rectilinear configuration when disposed at equilibrium at said detached position;

wherein said central section is integral with said proximal section and said distal section;

wherein each of said fasteners is attached to an opposed longitudinal rectilinear edge of said proximal section and is oriented perpendicular thereto, respectively; wherein each of said fasteners has a plurality of teeth protruding only inwardly towards said central longitudinal axis;

wherein said single, unitary, and resiliently foldable layer further has a plurality of first friction inducing members statically attached to said proximal section; and a plurality of second friction inducing members statically attached to said distal section and offset from said plurality of first friction inducing members;

wherein each of said plurality of first friction inducing members and said plurality of second friction inducing members remain spaced apart when said proximal section is attached to said distal section;

wherein said proximal section has a first planar top most surface and a first planar bottom most surface opposed therefrom;

wherein said distal section has a second planar top most surface and a second planar bottom most surface opposed therefrom;

wherein said proximal section has a first uniform cross-sectional thickness equal to a second uniform cross-sectional thickness of said distal section.

10. The sock pair accessory of claim 9, wherein said central section has a cross-sectional thickness less than said first uniform cross-sectional thickness of said proximal section and said second uniform cross-sectional thickness of said distal section, respectively;

wherein said central section has a central latitudinal axis registered orthogonal to said central longitudinal axis;

wherein said central latitudinal axis is medially disposed between said proximal section and said distal section.

11. The sock pair accessory of claim 10, wherein said layer further comprises:

a first shoulder located at a first junction between said central section and said proximal section; and a second shoulder located at a second junction between said central section and said distal section;

wherein said first shoulder remains spaced apart from said second shoulder when said fasteners are engaged with said distal section.

12. The sock pair accessory of claim 11, wherein each of said proximal section and said distal section has a plurality of apertures equidistantly offset from said central latitudinal axis.

13. The sock pair accessory of claim 12, wherein said central section is configured to be a living hinge.

14. The sock pair accessory of claim 13, wherein each of said plurality of first friction inducing members and said second plurality of friction inducing members has a cone shape.

15. The sock pair accessory of claim 14, wherein said proximal section has a shape that is symmetric to a shape of said distal section.

16. The sock pair accessory of claim 15, wherein said fasteners are statically affixed to said proximal section and disposed adjacent to said first shoulder.

* * * * *